US008400333B2

(12) United States Patent
Ishikawa et al.

(10) Patent No.: US 8,400,333 B2
(45) Date of Patent: Mar. 19, 2013

(54) MULTI-DIRECTIONAL INPUT APPARATUS

(75) Inventors: Shinji Ishikawa, Miyagi-ken (JP); Kuniharu Kutsuna, Aichi-ken (JP); Yasuhiko Yamazaki, Aichi-ken (JP)

(73) Assignees: Alps Electric Co., Ltd., Tokyo (JP); Denso Corporation, Aichi-Ken (JP)

( * ) Notice: Subject to any disclaimer, the term of this patent is extended or adjusted under 35 U.S.C. 154(b) by 1000 days.

(21) Appl. No.: 12/428,926

(22) Filed: Apr. 23, 2009

(65) Prior Publication Data

US 2009/0273490 A1 Nov. 5, 2009

(30) Foreign Application Priority Data

May 2, 2008 (JP) ..... 2008-120304
Aug. 11, 2008 (JP) ..... 2008-206847

(51) Int. Cl.
*H01C 10/16* (2006.01)
*H01H 9/00* (2006.01)

(52) U.S. Cl. ..... 341/35; 338/128; 200/4

(58) Field of Classification Search ..... 341/20, 341/35; 200/4, 406; 338/128
See application file for complete search history.

(56) References Cited

U.S. PATENT DOCUMENTS 4,103,559 A * 8/1978 Kohler ..... 74/471 XY
4,689,449 A * 8/1987 Rosen ..... 200/6 A
5,176,041 A * 1/1993 Meier et al. ..... 74/471 XY
5,229,742 A * 7/1993 Miyamoto et al. ..... 338/128
5,491,462 A * 2/1996 Cecchi et al. ..... 338/128
6,118,086 A * 9/2000 Isikawa ..... 200/6 A
6,275,139 B1 * 8/2001 Shimomura et al. ..... 338/128
6,344,618 B1 * 2/2002 Sato ..... 200/6 A
6,344,619 B1 * 2/2002 Yamasaki et al. ..... 200/6 A
6,441,325 B2 * 8/2002 Takahashi et al. ..... 200/4
6,617,957 B2 * 9/2003 Ishikawa ..... 338/128

FOREIGN PATENT DOCUMENTS

JP 2002-099337 4/2002

* cited by examiner

*Primary Examiner* — Daniel Wu
*Assistant Examiner* — Mohamed Barakat
(74) *Attorney, Agent, or Firm* — Brinks Hofer Gilson & Lione

(57) ABSTRACT

A multi-directional input apparatus includes an operating member including a shaft portion which extends to the outside, a housing having an opening through which the shaft portion extends and configured to support the operating member in a tiltable manner, interlocking members moved by the operating member when the shaft portion is tilted, and detectors which detect changes in the positions of the interlocking members. A sliding member is externally fitted to the shaft portion such that the sliding member is movable in an axial direction, and a coil spring is disposed between a flange provided on the shaft portion and the sliding member. A rubbing surface of the sliding member is in elastic contact with a receiving surface on an inner wall of an annular edge portion surrounding the opening. The rubbing surface and the receiving surface are spherical surfaces centered on a tilting center of the shaft portion.

6 Claims, 10 Drawing Sheets

MULTI-DIRECTIONAL INPUT APPARATUS

CLAIM OF PRIORITY

This application claims benefit of the Japanese Patent Application No. 2008-120304 filed on May 2, 2008 and No. 2008-206847 filed on Aug. 11, 2008, which are hereby incorporated by reference.

BACKGROUND OF THE INVENTION

1. Field of the Invention

The present invention relates to a multi-directional input apparatus which includes an operating member provided with a shaft portion and which outputs an electric signal in accordance with a tilting direction and a tilting angle of the shaft portion when the shaft portion is tilted. More specifically, the present invention relates to a technique for suppressing rattling of the shaft portion of the operating member which can be tilted in multiple directions.

2. Description of the Related Art

In this type of multi-directional input apparatus, when an operating force is applied such that the shaft portion of the operating member is tilted, positions of a pair of interlocking members driven by the operating member are changed. The changes in the positions of the interlocking members are detected by detectors, such as variable resistors and rotary encoders. In the multi-directional input apparatus, the shaft portion of the operating member extends to the outside through an opening in a housing, and the operating member is engaged with the pair of interlocking members in the housing. The operating member is supported such that the shaft portion thereof can be tilted in multiple directions, and the pair of interlocking members are supported such that axial directions thereof are perpendicular to each other and such that the interlocking members are rotatable. The shaft portion of the operating member extends in a direction away from a tilting center around which the shaft portion is tilted, and a part at which the operating force is applied is generally distant from the tilting center. Therefore, there may be a case where it is necessary to suppress rattling of the shaft portion when the shaft portion is tilted.

Japanese Unexamined Patent Application Publication No. 2002-99337 describes an example of a multi-directional input apparatus having a structure for suppressing rattling of the operating member. In this multi-directional input apparatus, a pair of sliding members, which are upper and lower sliding members, and a compression coil spring are provided on the shaft portion of the operating member. The sliding members are moveable in an axial direction of the shaft portion, and have rubbing surfaces which are in elastic contact with respective receiving surfaces provided on the interlocking members. In this example of the related art, the rubbing surface of the upper sliding member is a curved surface that is convex upward, and the rubbing surface of the lower sliding member is a curved surface that is convex downward. The compression spring is disposed between the pair of sliding members and elastically biases the sliding members such that the sliding members are pressed away from each other. One of the interlocking members driven by the operating member has a concave receiving surface at the bottom, and this receiving surface is in elastic contact with the rubbing surface of the upper sliding member. The other one of the interlocking members driven by the operating member has a concave receiving surface at the top, and this receiving surface is in elastic contact with the rubbing surface of the lower sliding member. Thus, when an operating force is applied and the shaft portion of the operating member is tilted, the sliding members smoothly slide along the respective receiving surfaces of the interlocking members in accordance with the tilting direction. Therefore, rattling of the shaft portion of the operating member can be prevented when the shaft portion is tilted, and the operability is improved.

In the above-described example of the related art, the pair of interlocking members are supported such that the axial directions thereof are perpendicular to each other and such that the interlocking members are rotatable, and electric signals corresponding to the rotation directions and the rotation angles of the interlocking members are output from the respective variable resistors. Therefore, when the shaft portion of the operating member is tilted in an arbitrary direction, the tilting direction and the tilting angle can be detected on the basis of the output values obtained by the variable resistors.

In the example of the related art disclosed in Japanese Unexamined Patent Application Publication No. 2002-99337, the upper and lower sliding members, which are externally fitted to the shaft portion of the operating member, are in elastic contact with different receiving surfaces. Accordingly, it is difficult to set sliding resistances between the sliding members and the respective receiving surfaces equal to each other. Thus, the sliding resistances vary in accordance with the tilting direction of the shaft portion, which degrades the operational feel. In addition, in the example of the related art, the compression spring is disposed between the sliding members and elastically biases the sliding members against the upper and lower interlocking members. Therefore, the process of assembling these movable members is not easy, and it is difficult to reduce the size of the apparatus.

SUMMARY OF THE INVENTION

In light of the above-described situation, the present invention provides a multi-directional input apparatus in which a sliding resistance generated when a shaft portion of an operating member is tilted does not vary in accordance with a tilting direction and which facilitates size reduction and assembly of the multi-directional input apparatus.

According to an aspect of the present invention, a multi-directional input apparatus includes an operating member including a shaft portion, the shaft portion extending to the outside; a supporting unit configured to support the operating member such that the shaft portion is tiltable in multiple directions; a detector configured to detect tilting of the shaft portion; a restraining member provided with an opening through which the shaft portion extends and an annular edge portion surrounding the opening, the annular edge portion serving as a receiving portion; a sliding member externally fitted to the shaft portion such that the sliding member is movable in an axial direction; and an elastic member configured to elastically bias the sliding member against the receiving portion. At least one of a rubbing portion of the sliding member and a receiving surface of the receiving portion has a spherical shape centered on a tilting center of the shaft portion. The rubbing portion is provided at a first side of the sliding member, and the receiving surface is in contact with the rubbing portion. The elastic member is held by the operating member.

In the multi-directional input apparatus having the above-described structure, the rubbing portion of the sliding member externally fitted to the shaft portion and biased by the elastic member is in elastic contact with the receiving portion of the restraining member. One or both of the rubbing portion and the receiving portion extend along an aspherical surface centered on the tilting center of the shaft portion of the operating member. Therefore, irrespective of the direction in which the shaft portion is tilted, the sliding member can smoothly slide along the receiving portion. As a result, rattling can be prevented and the sliding resistance between the rubbing portion and the receiving portion can be prevented from varying in accordance with the tilting direction. In addition, in the multi-directional input apparatus, rattling which may occur when the shaft portion of the operating member is tilted can be prevented irrespective of the tilting direction simply by placing a single sliding member between the elastic member held by the operating member and the receiving portion of the restraining member. Therefore, the overall size of the apparatus can be reduced and the apparatus can be easily assembled.

In the above-described structure, the elastic member may include a coil spring, and the coil spring may be disposed between a flange provided on the shaft portion and a spring receiver provided at a second side (side opposite to the rubbing portion) of the sliding member. In such a case, when the shaft portion is tilted, the rubbing portion of the sliding member can be elastically biased against the receiving portion with a stable urging force. Therefore, a desired sliding resistance can be generated between the rubbing portion and the receiving portion. In addition, since the coil spring can be easily fitted to the shaft portion of the operating member, the apparatus can be easily assembled.

In addition, according to another aspect of the present invention, a multi-directional input apparatus includes a restraining member having a receiving portion surrounding an opening; an operating member having a shaft portion which extends to the outside through the opening; a supporting unit configured to support the operating member such that the shaft portion is tiltable in multiple directions; a sliding member externally fitted to the shaft portion such that the sliding member is movable in an axial direction of the shaft portion, the sliding member sliding along the receiving portion when the shaft portion is tilted; an elastic member configured to elastically bias the sliding member against the receiving portion; and a detector configured to detect tilting of the shaft portion. The sliding member has a rubbing surface at the first side thereof, the rubbing surface being in elastic contact with the receiving portion and being formed along a convex spherical surface centered on the tilting center of the shaft portion. The elastic member includes a compression coil spring wound into a tapered shape, a diameter of the compression coil spring at a distal end being smaller than a diameter of the compression coil spring at a proximal end, the compression coil spring being disposed in a storage space provided at a second side of the sliding member. The proximal end of the compression coil spring is held by a flange provided on the operating member, and the distal end of the compression coil spring elastically biases the sliding member in a direction away from the tilting center while a movement of the sliding member is restrained by the receiving portion.

In the multi-directional input apparatus having the above-described structure, the compression coil spring held by the flange of the operating member elastically biases the sliding member which is externally fitted to the shaft portion, so that the rubbing surface of the sliding member is in elastic contact with the receiving portion of the restraining member. In addition, the rubbing surface of the sliding member extends along a convex spherical surface centered on the tilting center of the shaft portion of the operating member. Therefore, irrespective of the direction in which the shaft portion is tilted, the sliding member can smoothly slide along the receiving portion. As a result, rattling can be prevented and the sliding resistance between the rubbing surface and the receiving portion can be prevented from varying in accordance with the tilting direction. In addition, since the compression coil spring, which is wound along a tapered surface, is disposed in a storage space provided at the second side (side opposite to the side at which the rubbing surface is formed) of the sliding member, the overall size of the apparatus can be reduced.

In the above-described structure, preferably, the supporting means includes a drive member which supports the operating member with a first rotating shaft and a base which supports the drive member with a second rotating shaft, an axial direction of the second rotating shaft being perpendicular to an axial direction of the first rotating shaft. In addition, preferably, the restraining member is attached to the base. In such a case, the operating member can be supported such that the shaft portion thereof is tiltable in multiple directions with a simple structure. In addition, the restraining member can be attached to the base after the compression coil spring and the sliding member are externally fitted to the shaft portion of the operating member attached to the base. Thus, the apparatus can be easily assembled.

In such a case, preferably, the apparatus further includes a housing which is configured to house the base and which includes a top lid portion with an upper opening which faces the opening in the restraining member and through which the shaft portion of the operating member extends, and the restraining member is held between the top lid portion of the housing and the base. In this case, the restraining member can be easily fixed to the base without using attachment screws or the like. Therefore, the multi-directional input apparatus can be more easily assembled. In this case, preferably, the restraining member is provided with a pair of positioning projections inserted in a pair of positioning holes formed in the base. Accordingly, the restraining member can be extremely easily positioned and attached to the base.

DESCRIPTION OF THE PREFERRED EMBODIMENTS

Figure 1:
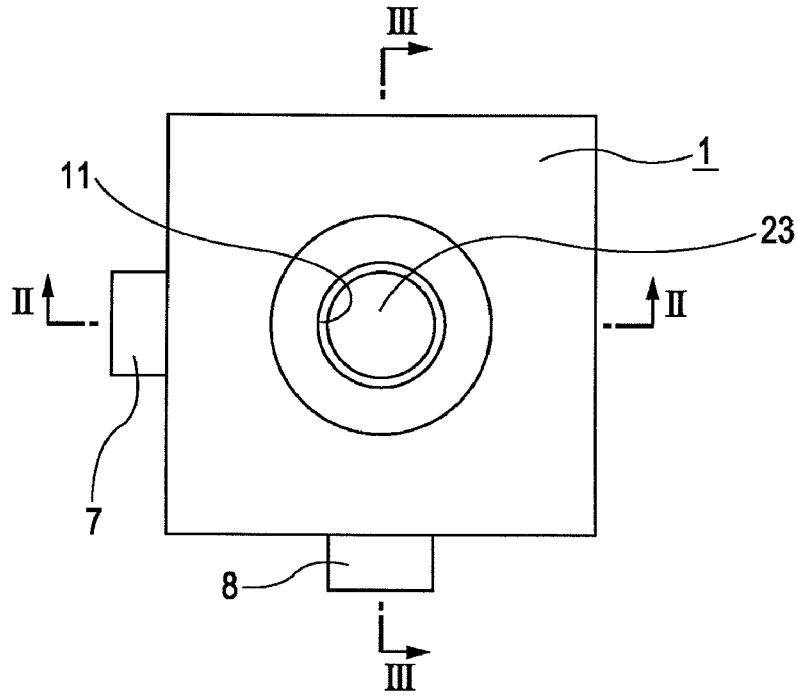
FIG. 1 is a top view of a multi-directional input apparatus according to a first embodiment of the present invention.
Figure 2:
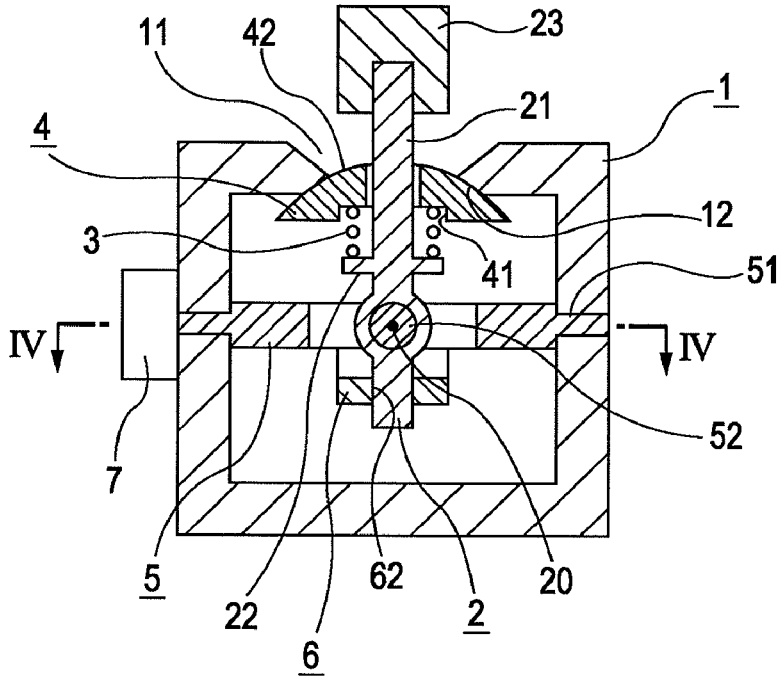
FIG. 2 is a sectional view of FIG. 1 taken along line II-II.
Figure 3:
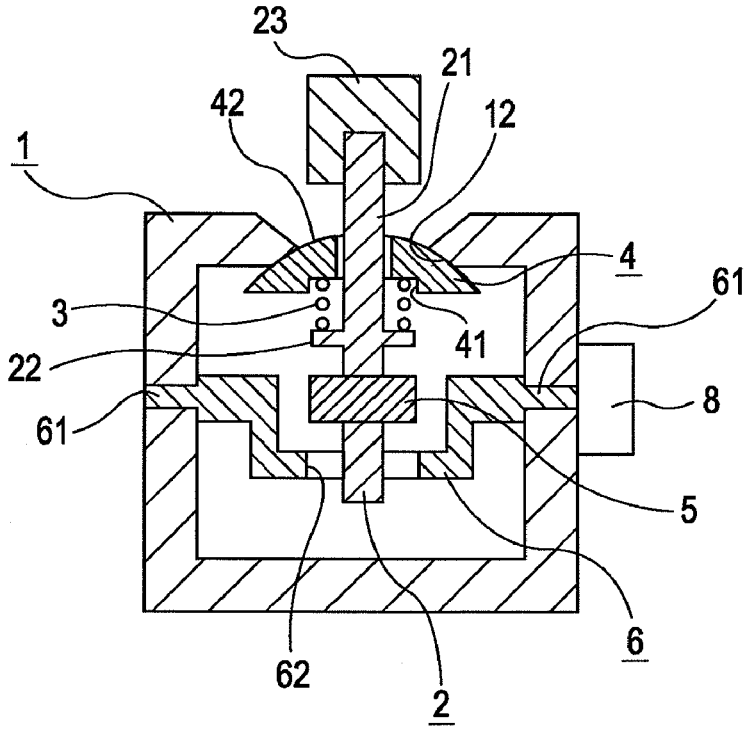
FIG. 3 is a sectional view of FIG. 1 taken along line III-III.
Figure 4:
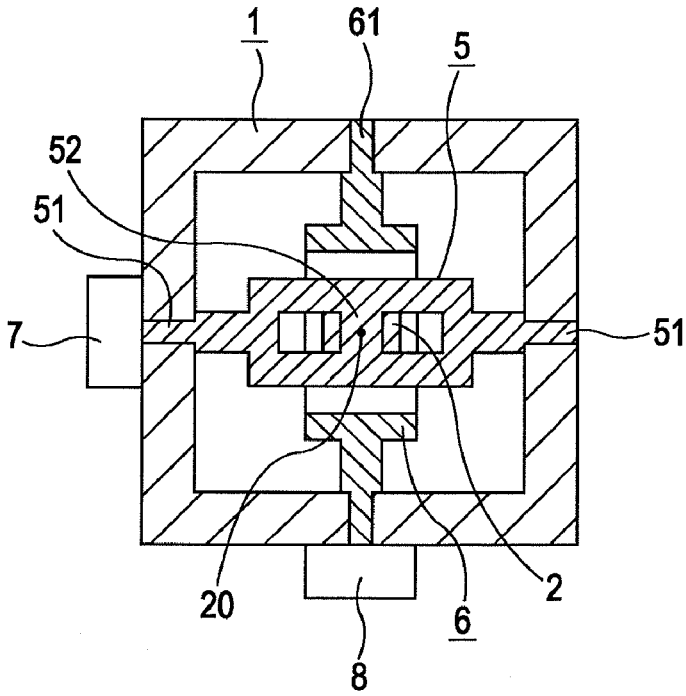
FIG. 4 is a sectional view of FIG. 2 taken along line IV-IV.

Embodiments of the present invention will be described with reference to the accompanying drawings. FIG. 1 is a top view of a multi-directional input apparatus according to a first embodiment of the present invention. FIG. 2 is a sectional view of FIG. 1 taken along line II-II, FIG. 3 is a sectional view of FIG. 1 taken along line III-III, and FIG. 4 is a sectional view of FIG. 2 taken along line IV-IV.

The multi-directional input apparatus shown in the above-mentioned figures basically includes a box-shaped housing 1 which serves as a restraining member; an operating member 2 which includes a shaft portion 21 and which is capable of being tilted; a coil spring 3 held by the shaft portion 21 of the operating member 2; a dome-shaped sliding member 4 which is elastically biased by the coil spring 3; a first interlocking member 5 and a second interlocking member 6 which are moved when the operating member 2 is operated; a first detector 7 which detects a change in the position of the first interlocking member 5; and a second detector 8 which detects a change in the position of the second interlocking member 6. Although not shown in the figures, the first and second detectors 7 and 8 are electrically connected to an external circuit.

An opening 11 is formed in a top lid portion of the housing 1, and an inner wall of an annular edge portion surrounding the opening 11 is formed as a band-shaped, curved receiving surface 12 which extends continuously along the entire circumference of the opening 11. The receiving surface 12 is a concave spherical surface centered on a tilting center 20 around which the shaft portion 21 of the operating member 2 is tilted. The housing 1 includes a first pair of side walls which face each other and which support rotating shafts 51 of the first interlocking member 5 such that the rotating shafts 51 can rotate. The first detector 7 is fixed to one of the first pair of side walls. The housing 1 also includes a second pair of side walls which face each other and which support rotating shafts 61 of the second interlocking member 6 such that the rotating shafts 61 can rotate. The second detector 8 is fixed to one of the second pair of side walls.

The operating member 2 is rotatably attached to a central columnar portion 52 of the first interlocking member 5 in the housing 1. The center of the central columnar portion 52 coincides with the tilting center 20 of the shaft portion 21. An axial direction of the central columnar portion 52 is perpendicular to an axial direction of the rotating shafts 51. Therefore, the operating member 2 supported by the first interlocking member 5 in the housing 1 can be tilted in multiple directions. The shaft portion 21 of the operating member 2 extends to the outside of the housing 1 through the opening 11, and an operating knob 23 is fixed to the shaft portion 21 at the top end thereof. A flange 22 is provided on the shaft portion 21 so as to project from the shaft portion 21 at a position near the bottom end thereof. The flange 22 holds the coil spring 3 in the housing 1, and is formed integrally with the shaft portion 21 in the present embodiment. However, the flange 22 may also be an individual flange which is externally fitted to the shaft portion 21 at a predetermined position.

The coil spring 3 is externally fitted to the shaft portion 21 of the operating member 2 and is placed on the flange 22. A top end portion of the coil spring 3 is retained by a spring receiver 41 formed in the bottom surface of the sliding member 4. The coil spring 3 is placed between the sliding member 4 and the flange 22 in a compressed state.

The sliding member 4 is externally fitted to the shaft portion 21 of the operating member 2 such that the sliding member 4 is movable in the axial direction, and a top surface of the sliding member 4 serves as a rubbing surface 42 which slides along the receiving surface 12 when the shaft portion 21 is tilted. The rubbing surface 42 is a convex spherical surface centered on the tilting center 20 of the shaft portion 21 of the operating member 2. The radius of curvature of the rubbing surface 42 is equal to the radius of curvature of the receiving surface 12. The spring receiver 41 has a recessed shape and is formed in the bottom surface of the sliding member 4. An urging force is constantly applied to the spring receiver 41 by the Coil spring 3. Therefore, the sliding member 4 is elastically biased upward by the coil spring 3 and the rubbing surface 42 is constantly in elastic contact with the receiving surface 12.

The rotating shafts 51 at the ends of the first interlocking member 5 are rotatably supported by the side walls of the housing 1. As described above, the operating member 2 is rotatably supported by the central columnar portion 52 of the first interlocking member 5 in the housing 1. The first interlocking member 5 is driven by the operating member 2 when the shaft portion 21 is tilted in a direction which crosses the axial line of the rotating shafts 51. The rotating shafts 61 at the ends of the second interlocking member 6 are rotatably supported by the other side walls of the housing 1. A bottom end portion of the operating member 2 is inserted through a long hole 62 formed in the second interlocking member 6 in the housing 1. The second interlocking member 6 is driven by the operating member 2 when the shaft portion 21 is tilted in a direction which crosses the axial line of the rotating shafts 61. The axial directions of the first interlocking member 5 and the second interlocking member 6 are perpendicular to each other, and the axial lines of the interlocking members 5 and 6 intersect at the tilting center 20 of the shaft portion 21. The axial line of the second interlocking member 6 coincides with the axial line of the central columnar portion 52.

The first detector 7 detects the rotation direction and the rotation angle of the rotating shafts 51 of the first interlocking member 5. The second detector 8 detects the rotation direction and the rotation angle of the rotating shafts 61 of the second interlocking member 6. The first and second detectors 7 and 8 are rotary encoders. However, other kinds of detectors, such as rotary volume controls (variable resistors), may also be used.

In the multi-directional input apparatus having the above-described structure, when the shaft portion 21 of the operating member 2 is tilted in a certain direction, the first interlocking member 5 and the second interlocking member 6, the axial directions of which are perpendicular to each other, are driven by the operating member 2 and are rotated in accordance with a direction in which the operating member 2 is tilted. The rotation directions and the rotation angles of the interlocking members 5 and 6 are detected by the first detector 7 and the second detector 8, respectively. Therefore, the tilting direction and the tilting angle of the shaft portion 21 can be determined from the electric signals output from the detectors 7 and 8.

In addition, in the multi-directional input apparatus, the sliding member 4, which is externally fitted to the shaft portion 21 of the operating member 2, is elastically biased by the coil spring 3 such that the rubbing surface 42 is in elastic contact with the receiving surface 12. The rubbing surface 42 and the receiving surface 12 are spherical surfaces with the same radius of curvature which are centered on the tilting center 20 of the shaft portion 21. Therefore, irrespective of the direction in which the shaft portion 21 is tilted, the sliding member 4 can smoothly slide along the receiving surface 12 and rattling can be prevented. In addition, the sliding resistance between the rubbing surface 42 and the receiving surface 12 does not vary in accordance with the tilting direction.

According to the present embodiment, when the shaft portion 21 is tilted, rattling of the shaft portion 21 can be prevented irrespective of the direction in which the shaft portion 21 is tilted. In addition, the structure of the present embodiment is designed such that the rattling can be prevented simply by placing a single sliding member 4 between the coil spring 3 held by the flange 22 of the shaft portion 21 and the receiving surface 12 formed on the inner wall of the top lid portion of the housing 1. Thus, the structure for preventing the rattling of the operating member 2 is extremely simple. Accordingly, the size of the multi-directional input apparatus can be easily reduced. In addition, the coil spring 3 and the sliding member 4 can be easily attached to the operating member 2 and the housing 1. Thus, the multi-directional input apparatus can be easily assembled.

According to the above-described first embodiment, the coil spring 3, which is mounted on the flange 22 in a compressed state, is used as an elastic member which biases the sliding member 4 toward the receiving surface 12. However, another kind of elastic member which is held by the operating member 2 may also be used. In the case where the coil spring 3 is used as the elastic member, the coil spring 3 can be easily assembled to the shaft portion 21. Therefore, the multi-directional input apparatus can be easily assembled. In addition, when the shaft portion 21 is tilted, the rubbing surface 42 of the sliding member 4 can be elastically biased against the receiving surface 12 with a stable urging force. Therefore, a desired sliding resistance can be easily generated between the rubbing surface 42 and the receiving surface 12.

In the above-described first embodiment, both the rubbing surface 42 and the receiving surface 12 are spherical. However, even if one of the rubbing surface 42 and the receiving surface 12 is aspherical, rattling of the shaft portion 21 and variation in the sliding resistance can be prevented irrespective of the tilting direction as long as the other one of the rubbing surface 42 and the receiving surface 12 is formed as a spherical surface centered on the tilting center 20.

Figure 5:
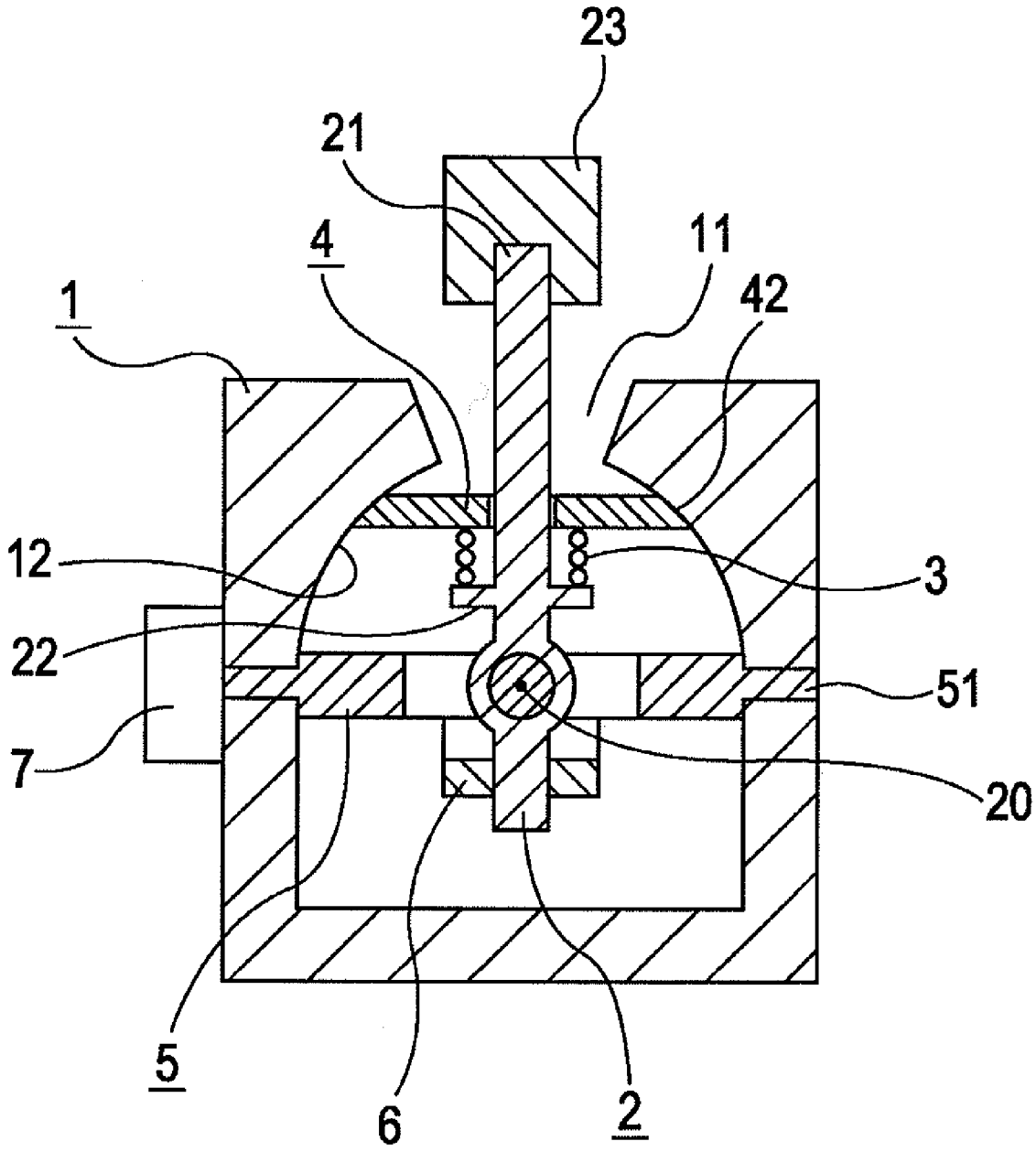
FIG. 5 is a sectional view of a multi-directional input apparatus according to a second embodiment of the present invention.

FIG. 5 is a sectional view of a multi-directional input apparatus according to a second embodiment of the present invention. In FIG. 5, components similar to those in FIG. 2 are denoted by the same reference numerals.

The structure of the multi-directional input apparatus shown in FIG. 5 is basically similar to that of the multi-directional input apparatus according to the first embodiment except the shapes of the sliding member 4 and the receiving surface 12. In the multi-directional input apparatus according to the second embodiment, a plate-shaped sliding member 4 is formed so as to cover the receiving surface 12. An outer peripheral surface of the sliding member 4 serves as a band-shaped, curved rubbing surface 42, and the rubbing surface 42 is in elastic contact with the receiving surface 12, which is a circular bowl-shaped curved surface, at various areas in accordance with the tilting direction and the tilting angle of the shaft portion 21. Also in the present embodiment, the rubbing surface 42 and the receiving surface 12 are formed as spherical surfaces with the same radius of curvature which are centered on the tilting center 20 of the shaft portion 21. Therefore, irrespective of the direction in which the shaft portion 21 is tilted, the sliding member 4 can smoothly slide along the receiving surface 12 and rattling can be prevented. In addition, the sliding resistance between the rubbing surface 42 and the receiving surface 12 does not vary in accordance with the tilting direction.

Figure 6:
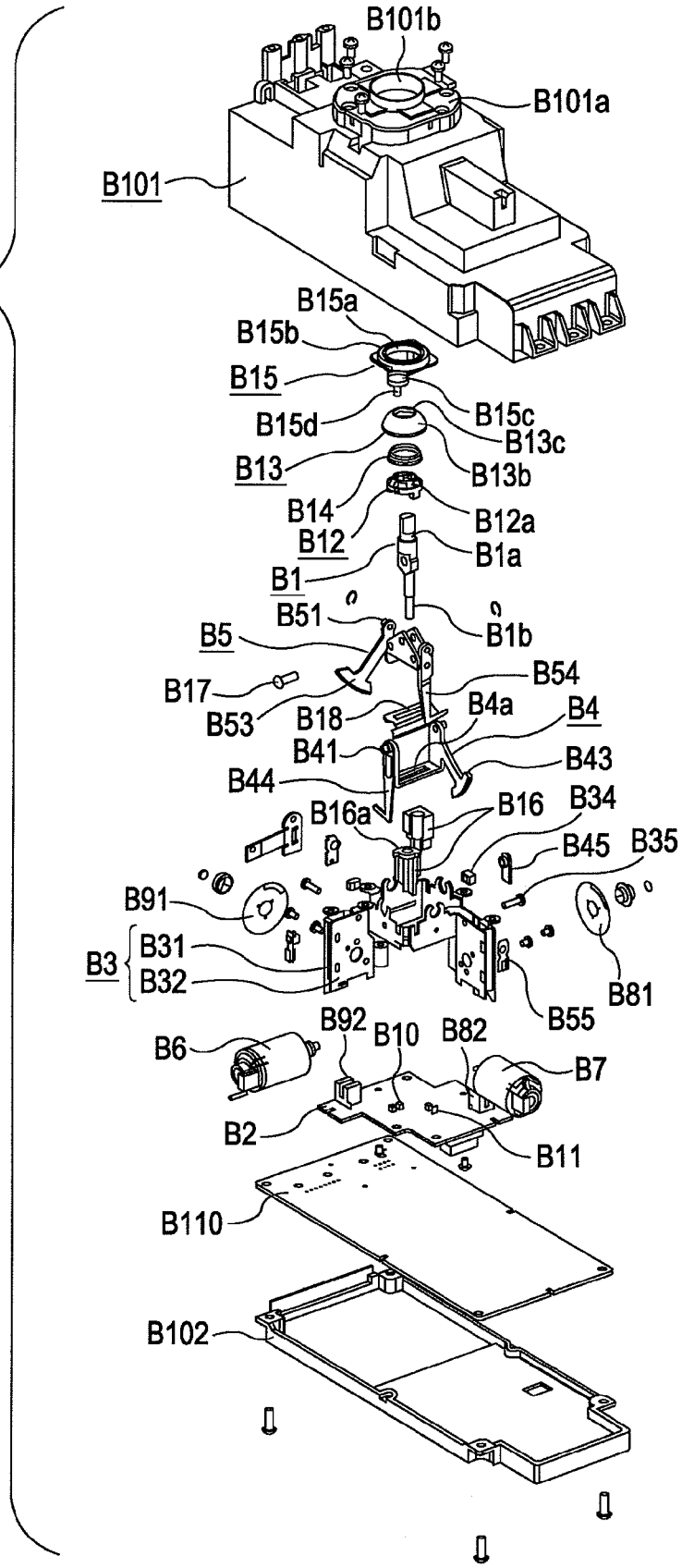
FIG. 6 is an exploded perspective view of a multi-directional input apparatus according to a third embodiment of the present invention.
Figure 7:
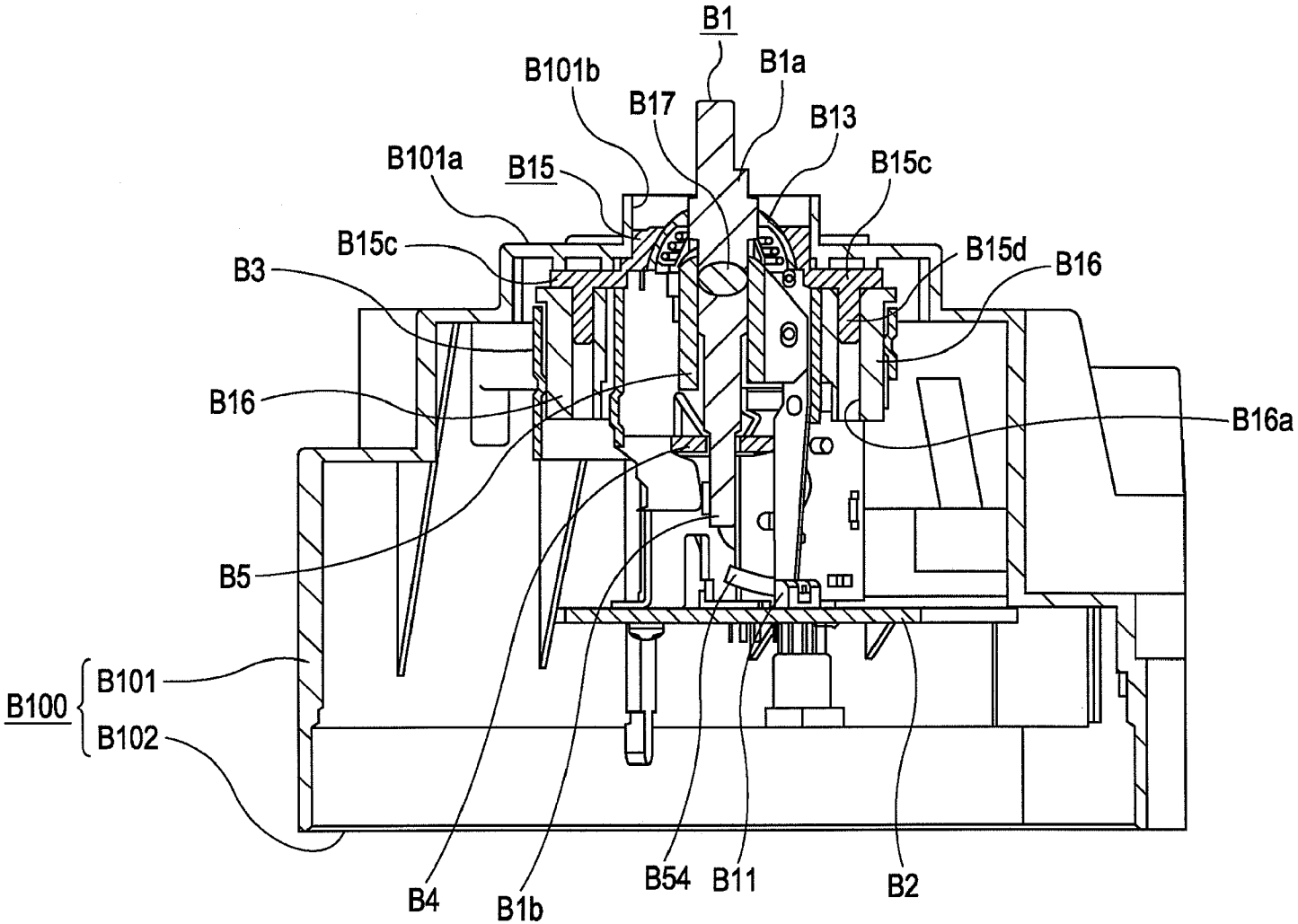
FIG. 7 is a sectional view of the multi-directional input apparatus according to the third embodiment.
Figure 8:
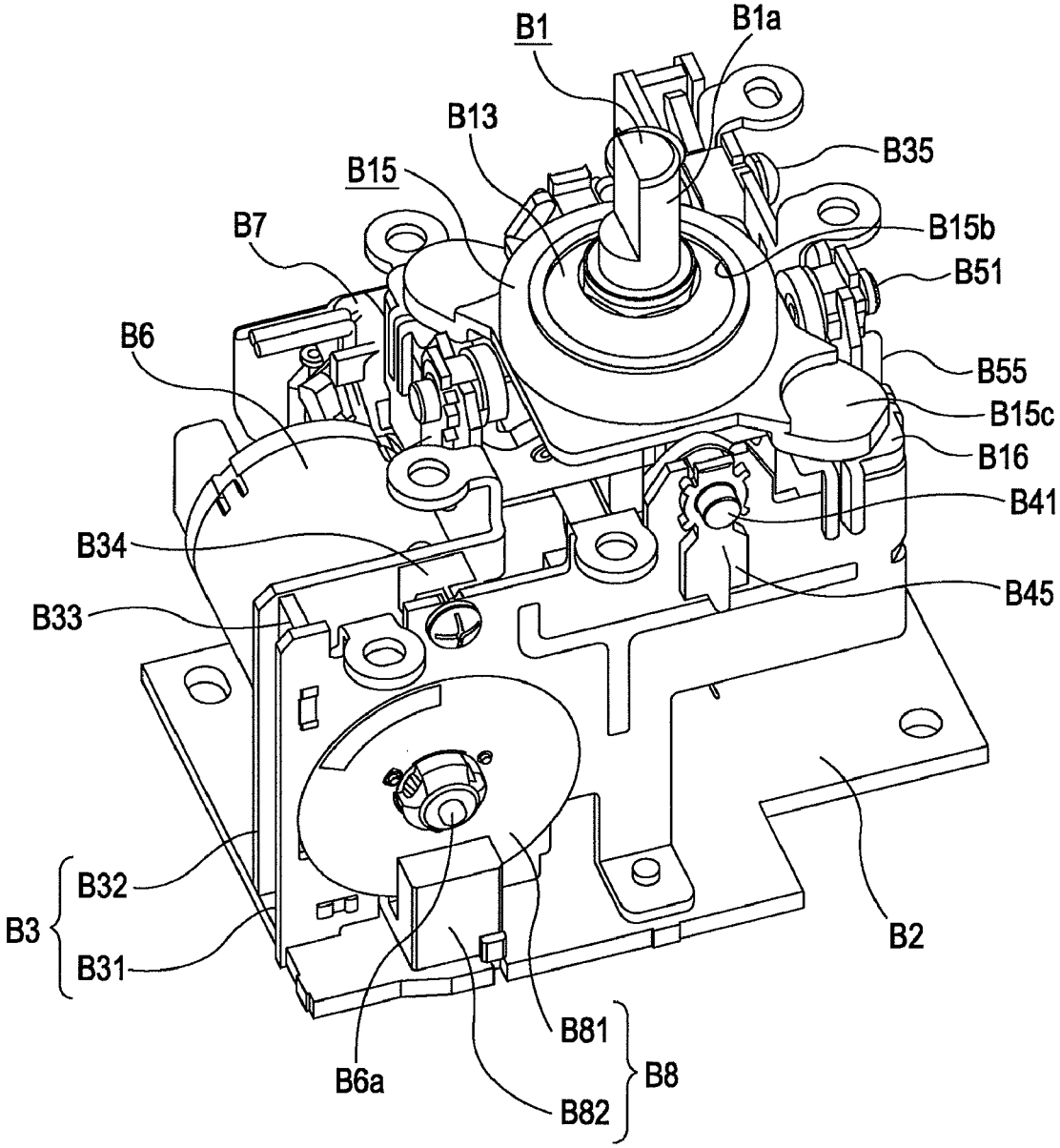
FIG. 8 is a perspective view illustrating the main section of the multi-directional input apparatus according to the third embodiment from which a housing and the like are removed.
Figure 9:
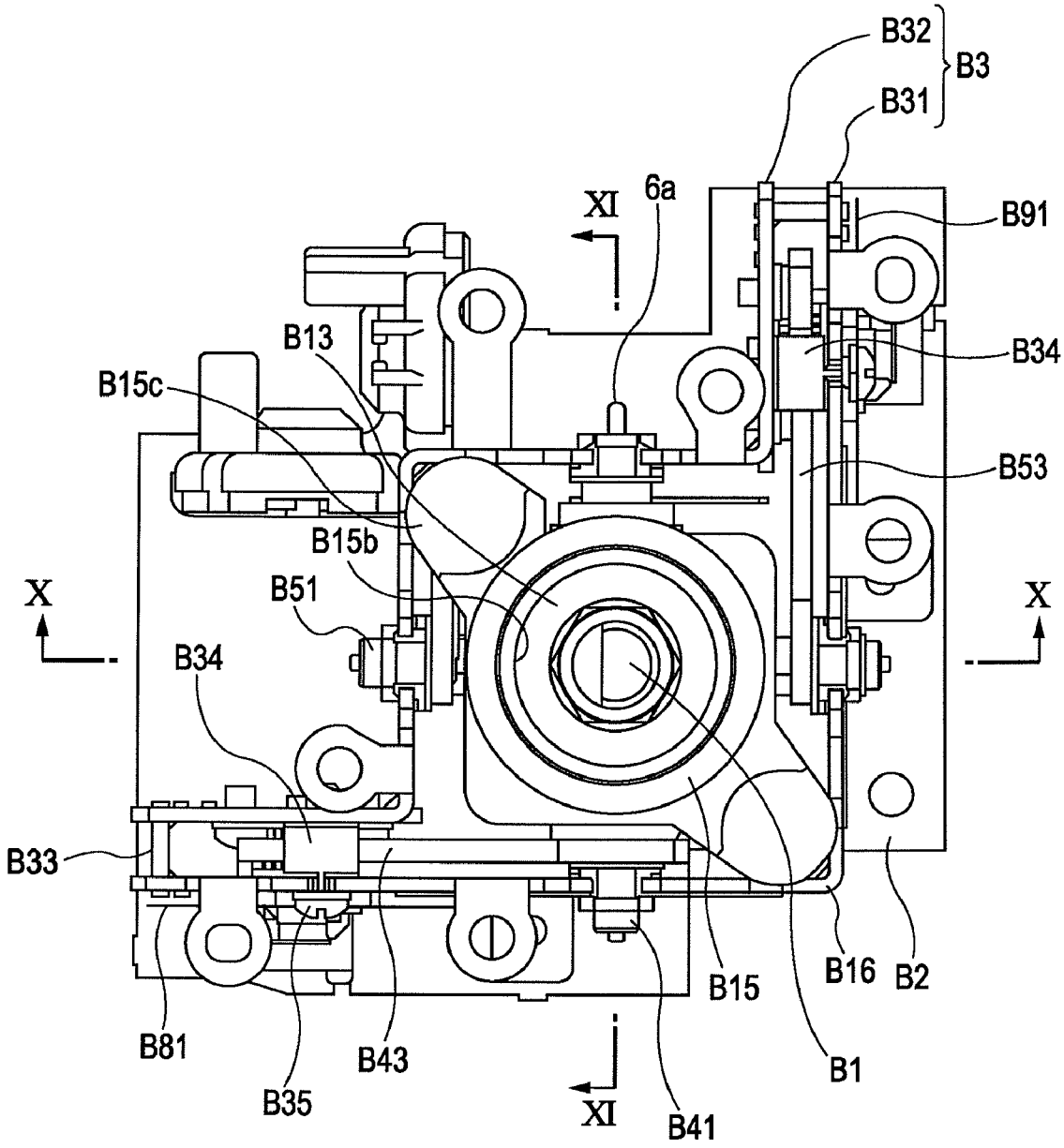
FIG. 9 is a plan view of the main section of the multi-directional input apparatus according to the third embodiment.
Figure 10:
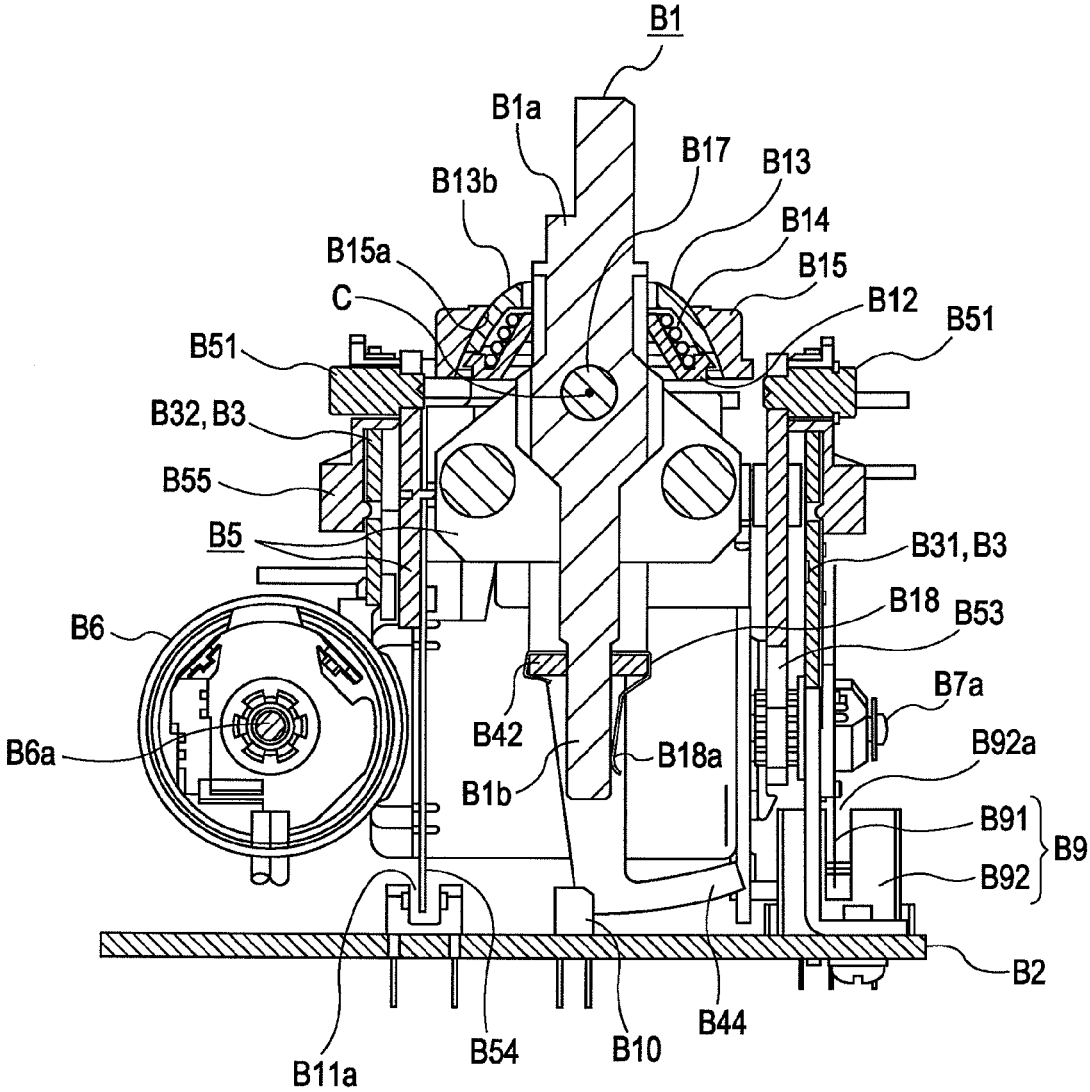
FIG. 10 is a sectional view of FIG. 9 taken along line X-X.
Figure 11:
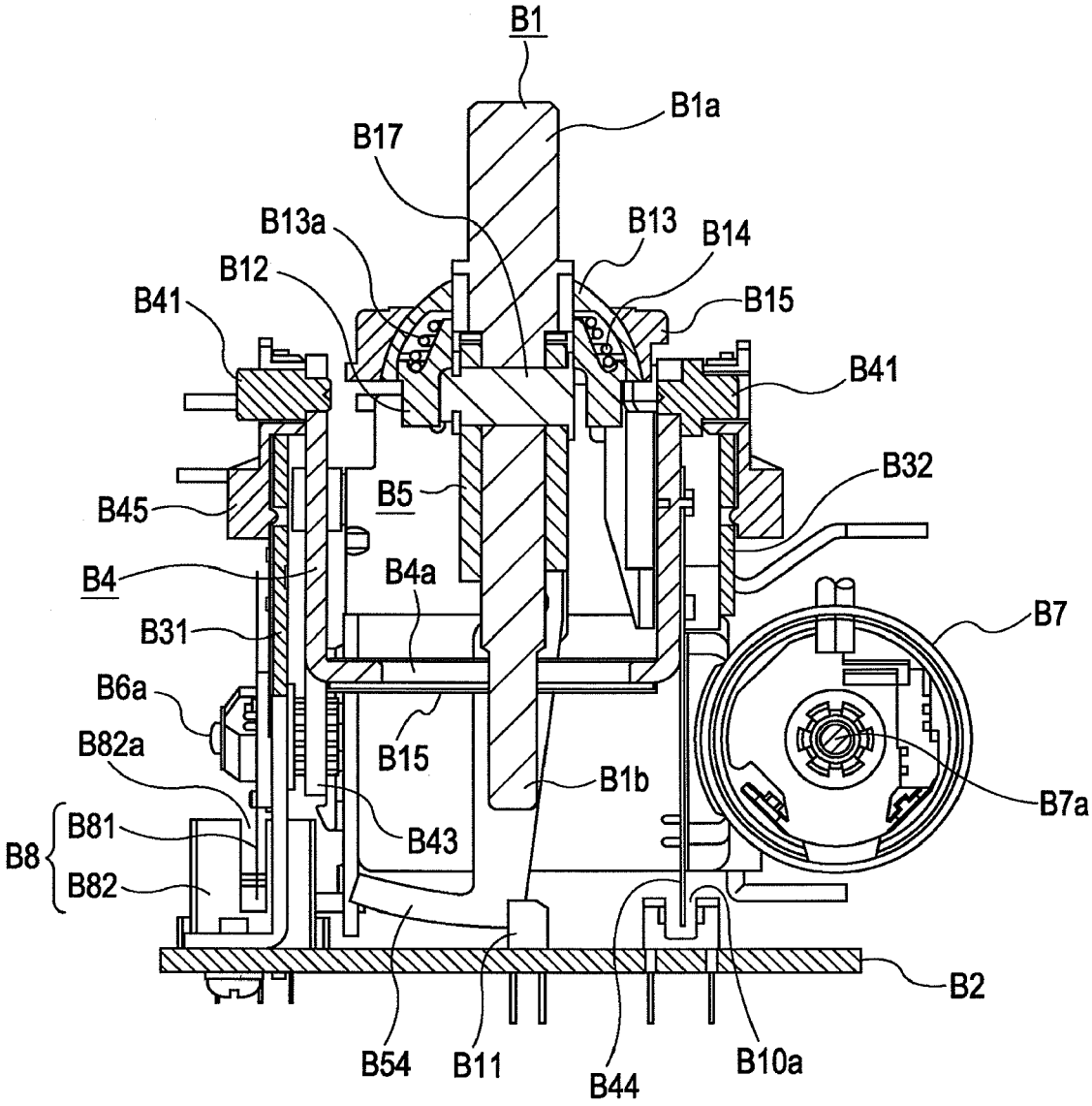
FIG. 11 is a sectional view of FIG. 9 taken along line XI-XI.
Figure 12:
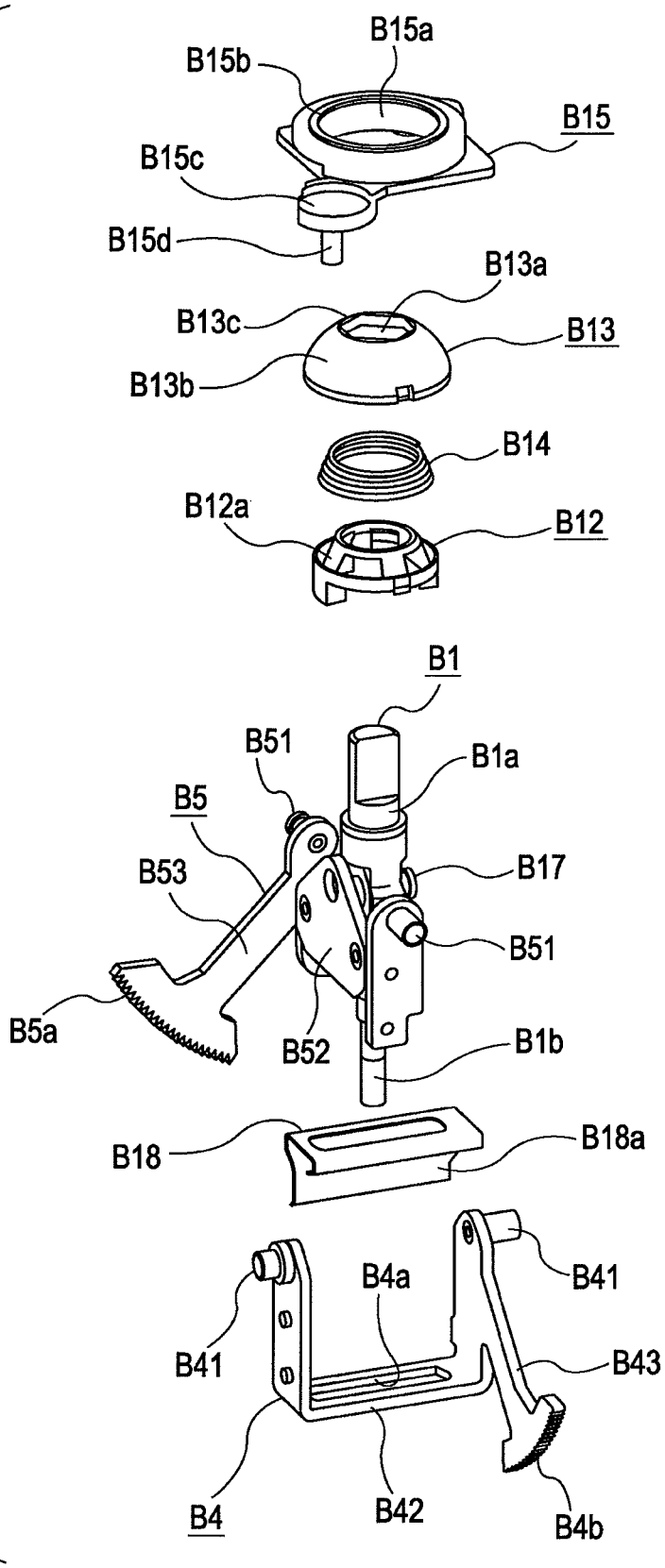
FIG. 12 is an exploded perspective view illustrating components arranged near an operating lever in the multi-directional input apparatus according to the third embodiment.

A third embodiment of the present invention will now be described with reference to the accompanying drawings. FIG. 6 is an exploded perspective view of a multi-directional input apparatus according to a third embodiment of the present invention. FIG. 7 is a sectional view of the multi-directional input apparatus. FIG. 8 is a perspective view illustrating the main section of the multi-directional input apparatus from which a housing and the like are removed. FIG. 9 is a plan view of the main section. FIG. 10 is a sectional view of FIG. 9 taken along line X-X. FIG. 11 is a sectional view of FIG. 9 taken along line XI-XI. FIG. 12 is an exploded perspective view illustrating components arranged near an operating lever in the multi-directional input apparatus. In FIG. 9, rotary motors are not shown.

The multi-directional input apparatus shown in the above-mentioned figures is a force-sense-imparting input apparatus which is installed in, for example, a center console of a vehicle and in which an electrically controlled force sensation is applied to an operating lever B1. An input operation can be performed by tilting an operating shaft portion B1*a* of the operating lever B1. The force-sense-imparting input apparatus is an input apparatus in which functions of control devices, such as an air conditioner, an audio device, and a navigation device, that are mounted on the vehicle are adjusted using a single operating member B1. An operation of selecting a device or adjusting the functions of the device are performed by manually operating the operating lever B1. The input apparatus has a force-feedback function in which a resistive sensation or an external force, such as thrust, is applied in accordance with the amount by which the operating lever B1 is operated and the direction in which the operating lever B1 is operated. Thus, a good operational feel can be produced and a desired operation can be reliably performed.

The main section of the multi-directional input apparatus according to the present embodiment is mounted on a mother board B110 in a housing B100 including an upper casing B101 and a lower casing B102 which are combined together. The operating shaft portion B1*a* of the operating lever B1 extends through an upper opening B101*b* formed in a top lid portion B101*a* of the upper casing B101, and projects upward. The main section of the multi-directional input apparatus includes a base B3 which stands upright on a circuit board B2; first and second drive levers B4 and B5 which are rotatably supported on the base B3 such that axial directions of the first and second drive levers B4 and B5 are perpendicular to each other; the operating lever B1 supported on the base B3 by the second drive lever B5 such that the operating lever B1 is tiltable; first and second rotary motors B6 and B7 mounted on the circuit board B2 such that rotating shafts B6*a* and B7*a* of the first and second rotary motors B6 and B7, respectively, extend perpendicular to each other; rotary encoders B8 and B9 and photo-interrupters B10 and B11 mounted on the circuit board B2; and a controller (not shown). When the operating lever B1 is tilted in an arbitrary direction, the drive lever B4 and the drive lever B5 are rotated by the operating force applied to the operating lever B1.

The operating lever B1 includes the operating shaft portion B1*a* which extends upward from a tilting center C (see FIG. 10) of the operating lever B1 and a drive shaft portion B1*b* which extends downward from the tilting center C.

An operating knob (not shown) is attached to the operating shaft portion B1*a*, which projects upward from the housing B100, at the top end thereof. A flange B12 having a tapered surface B12*a* is externally fitted to the operating shaft portion B1*a*, and a coil spring B14 which is wound into a tapered shape along the tapered surface B12*a* is placed on the flange B12. The coil spring B14 is placed between an annular inner bottom surface of the flange B12 and a surface of the inner wall of a dome-shaped sliding member B13 in a compressed state. A storage space B13*a* having a truncated conical shape for housing the coil spring B14 is formed at the bottom of the sliding member B13. The top surface of the sliding member B13 serves as a rubbing surface B13*b* which is in elastic contact with a receiving surface B15*a* of a restraining member B15, which is fixed to the base B3 by attachment members B16. The sliding member B13 slides along the receiving surface B15*a* when the operating lever B1 is tilted. The rubbing surface B13*b* of the sliding member B13 is a convex spherical surface centered on the tilting center C of the operating lever B1. The receiving surface B15*a* is a concave spherical surface having the same radius of curvature as that of the rubbing surface B13*b*. The sliding member B13 has a central hole B13*c* through which the operating shaft portion B1*a* extends. The flange B12, the coil spring B14, and the sliding member B13 are installed from above such that the operating shaft portion B1*a* is inserted therethrough. A large-diameter portion of the coil spring B14 at the bottom thereof serves as a proximal end portion which is supported by the flange B12. The other end portion of the coil spring B14 at the top constantly biases the sliding member B13 in a direction away from the tilting center C along the operating shaft portion B1*a*. The movement of the sliding member B13 in the above-mentioned direction is restricted by the restraining member B15 fixed to the base B3.

The drive shaft portion B1*b* of the operating lever B1 is inserted through a long hole B4*a* formed in the first drive lever B4. A lever shaft B17, which functions as a rotating shaft, is inserted through a central wide portion of the operating lever B1. The operating lever B1 is rotatably supported on the second drive lever B5 by the lever shaft B17.

The base B3 includes two support plates B31 and B32 which are combined together with connecting plates B33 and spacers B34 provided therebetween. The support plate B31 is a metal plate having an L shape in a plan view, and the support plate B32 is a metal plate having a W shape in a plan view. The support plates B31 and B32 are disposed so as to face each other and are strongly fixed to each other by crimping such that the connecting plates B33 are provided between the support plates B31 and B32 at the ends thereof. The distance between the support plates B31 and B32 is accurately set by the spacers B34 fixed to the support plates B31 and B32 with screws B35. The attachment members B16 have positioning holes B16*a* formed therein and are disposed on the base B3 at two positions which are opposite to each other.

The restraining member B15 has a circular opening B15*b* at which a top portion of the sliding member B13 is exposed, and an inner wall of an annular edge portion surrounding the opening B15*b* is formed as the receiving surface B15*a*. The opening B15*b* is exposed at the upper opening B101*b* formed in the upper casing B101, and the operating shaft portion B1*a* extends through the opening B15*b*, the central hole B13*c*, and the upper opening B101*b*. A pair of extending portions B15*c* are provided on the restraining member B15 such that the extending portions B15*c* project horizontally in opposite directions with the opening B15*b* at the center. In addition, a pair of positioning projections B15*d* are provided on the respective extending portions B15*c* so as to project downward. As shown in FIG. 7, the pair of positioning projections B15*d* are inserted into the positioning holes B16*a* formed in the attachment members B16 which are fitted to the base B3. The extending portions B15*c* are held between the attachment members B16 and the top lid portion B101*a* of the upper casing B101.

The first drive lever B4 includes a pair of shafts B41 which face each other, a frame portion B42 having the long hole B4*a* formed therein, and a gear portion B43 (see FIG. 12). The gear portion B43 projects from a side wall which stands upright at an end of the frame portion B42 and includes a tooth section B4*b* at an end of the gear portion B43. An L-shaped detection plate B44 is fixed to a side wall which stands upright at the other end of the frame portion B42. The shafts B41 are rotatably attached to a top-end portion of the base B3 with bearings B45. The axial line of the shafts B41 is parallel to the axial line of the lever shaft B17 and the longitudinal direction of the long hole 4*a*. When the operating shaft portion B1*a* is tilted in a direction which crosses the axial line of the shafts B41, the first drive lever B4 is driven by the drive shaft portion B1*b* and is rotated. When the first drive lever B4 is rotated, the detection plate B44 passes through a recess B10*a* in the photo-interrupter B10.

A leaf spring B18 having a tongue piece B18*a* is attached to the frame portion B42 of the first drive lever B4. When the leaf spring B18 is attached to the frame portion B42, the tongue piece B18*a* comes into elastic contact with the drive shaft portion B1*b* of the operating lever B1. Therefore, the drive shaft portion B1*b* is softly pressed against a side surface of the inner wall of the long hole B4*a*. The leaf spring B18 is provided to prevent rattling between the drive shaft portion B1*b* and the inner wall of the long hole B4*a*.

The second drive lever B5 includes a pair of shafts B51 which face each other, a holder B52 on which the operating lever B1 is rotatably supported by the lever shaft B17, and a gear portion B53 (see FIG. 12). The gear portion B53 projects from the holder B52 at one side thereof and includes a tooth section B5*a* at the end of the gear portion B53. An L-shaped detection plate B54 is fixed to the holder B52 at the other side. The shafts B51 are rotatably attached to a top-end portion of the base B3 with bearings B55. The axial line of the shafts B51 is perpendicular to the axial line of the first drive lever B4 and the axial line of the lever shaft B17. When the operating shaft portion B1*a* is tilted in a direction which crosses the axial line of the shafts B51, the second drive lever B5 is driven by the operating lever B1 and is rotated. Thus, the first and second drive levers B4 and B5 are supported on the base B3 such that the axial lines thereof extend perpendicular to each other, and the operating lever B1 is supported on the base B3 by the drive lever B5 such that the operating lever B1 can be tilted in multiple direction. When the second drive lever B5 is rotated, the detection plate B54 passes through a recess B11*a* in the photo-interrupter B11.

The rotary motors B6 and B7 are mounted on the circuit board B2 such that the rotating shafts B6*a* and B7*a* extend perpendicular to each other. The rotating shaft B6*a* of the first rotary motor B6 is connected to a central section of a code plate B81 included in the rotary encoder B8. The rotating shaft B6*a* and the code plate B81 rotate together. When an operating force for rotating the first drive lever B4 is applied, the rotating shaft B6*a* is rotated by the gear portion B43. Similarly, the rotating shaft B7*a* of the second rotary motor B7 is connected to a central section of a code plate B91 included in the rotary encoder B9. The rotating shaft B7*a* and the code plate B91 rotate together. When an operating force for rotating the second drive lever B5 is applied, the rotating shaft B7*a* is rotated by the gear portion B53.

The rotary encoder B8 includes the above-described code plate B81 and a photo-interrupter B82 which is mounted on the circuit board B2. A part of the code plate B81 is placed in a recess B82*a* in the photo-interrupter B82. The photo-interrupter B82 includes an LED (light emitting element) and a phototransistor (light receiving element) which face each other across the recess B82*a*, and information regarding the rotation of the code plate B81 can be obtained by the photo-interrupter B82. Similarly, the rotary encoder B9 includes the above-described code plate B91 and a photo-interrupter B92 which is mounted on the circuit board B2. A part of the code plate B91 is placed in a recess B92*a* in the photo-interrupter B92, and information regarding the rotation of the code plate B91 can be obtained by the photo-interrupter B92.

The photo-interrupter B10 includes an LED and a phototransistor (not shown) which face each other across the recess B10*a*. The photo-interrupter B10 outputs an ON signal when the detection plate B44 of the first drive lever B4 is not placed in the recess B10*a*. When the first drive lever B4 is rotated and the detection plate B44 enters the recess 10*a*, the light emitted from the LED is blocked and an OFF signal is output from the photo-interrupter B10. Similarly, the photo-interrupter B11 outputs an ON signal when the detection plate B54 of the second drive lever B5 is not placed in the recess B11*a*. When the detection plate B54 enters the recess B11*a*, an OFF signal is output from the photo-interrupter B11. The signals output from the photo-interrupters B10 and B11 are fed to the controller (not shown), and the controller calculates reference positions of the drive levers B4 and B5. The controller also receives signals obtained by the photo-interrupters B82 and B92 in the rotary encoders B8 and B9, respectively, and calculates the directions and amounts of rotation of the drive levers B4 and B5 with respect to the reference positions.

The above-described controller outputs control signals determined on the basis of data and programs stored in a memory to the rotary motors B6 and B7. The control signals correspond to an operational feel to be produced by the operating lever B1, and represents commands for, for example, generating vibrations or changing an operational force (resistive force or thrust). Circuit components of the controller are mounted on the bottom surface of the circuit board B2 or on the mother board B110.

The operation of the multi-directional input apparatus having the above structure will be now be described. When the system of the multi-directional input apparatus is activated (turned on), the controller reads the detection signals obtained by the photo-interrupters B10 and B11 and outputs the control signals to the rotary motors B6 and B7. The rotary motors B6 and B7 rotate the drive levers B4 and B5, respectively, so that the operating lever B1 returns to the initial neutral position. In this step, the rotary motors B6 and B7 rotate the drive levers B4 and B5 such that the outputs from the photo-interrupters B10 and B11 change from OFF to ON. The operating lever B1 reaches the neutral position when the outputs from the photo-interrupters B10 and B11 are both changed from OFF to ON.

Thus, the operating lever B1 is automatically returned to the neutral position. In this state, when an operator tilts the operating lever B1 in a certain direction, the first drive lever B4 and the second drive lever B5 are rotated by the operating lever B1 in accordance with the direction in which the operating lever B1 is tilted. The code plate B81 is rotated when the first drive lever B4 rotates around the center of the shafts B41, and the code plate B91 is rotated when the second drive lever B5 rotates around the center of the shafts B51. Accordingly, the information regarding the rotations of the code plates B81 and B91 is detected by the photo-interrupters B82 and B92 of the rotary encoders B8 and B9, respectively, and signals representing the information regarding the rotations are fed to the controller.

The controller calculates the directions and amounts of rotations of the drive levers B4 and B5 on the basis of the detection signals from the photo-interrupters B10 and B11 and the detection signals from the photo-interrupters B82 and B92, and outputs predetermined control signals to the rotary motors B6 and B7. For example, when the operating lever B1 is tilted in a certain direction by a certain amount, rotating forces based on the above-described control signals are transmitted to the drive levers B4 and B5 from the rotary motors B6 and B7, respectively. Accordingly, a resistive force is applied to the operating lever B1 through the drive levers B4 and B5 against the force applied to tilt the operating lever B1. As a result, the operator who manually operates the operating lever B1 recognizes the force applied to the operating lever B1 as a click feel.

As described above, in the multi-directional input apparatus of the present embodiment, the rubbing surface B13*b* of the sliding member B13 is in elastic contact with the receiving surface B15*a* of the restraining member B15 due to the urging force applied by the coil spring B14, and the rubbing surface B13*b* is a convex spherical surface centered on the tilting center C of the operating lever B1. In addition, the receiving surface B15*a* is a concave spherical surface having the same radius of curvature as that of the rubbing surface B13*b*. Therefore, the sliding member B13 can smoothly slide along the receiving surface B15*a* irrespective of the direction in which the operating shaft portion B1*a* is tilted. As a result, rattling of the operating shaft portion B1*a* can be prevented when the operating shaft portion B1*a* is tilted and the sliding resistance between the rubbing surface B13*b* and the receiving surface B15*a* can be prevented from varying in accordance with the tilting direction. In addition, since the coil spring B14 which is wound into a tapered shape is placed in the storage space B13*a* formed at the bottom of the sliding member B13, the overall size of the apparatus can be easily reduced.

In addition, in the multi-directional input apparatus according to the present embodiment, the operating lever B1 is rotatably supported on the second drive lever B5 by the lever shaft B17, and the second drive lever B5 is rotatably supported on the base B3 by the shafts B51 whose axial line is perpendicular to the axial line of the lever shaft B17. Thus, the operating lever B1 is supported such that the operating lever B1 can be tilted in multiple directions with a simple structure. In the process of assembling the multi-directional input apparatus, first, the coil spring B14 and the sliding member B13 are externally fitted to the operating shaft portion B1*a* of the operating lever B1 which is attached to the base B3. Then, the restraining member B15 can be easily attached to the base B3 by inserting the positioning projections B15*d* into the positioning holes B16*a* formed in the attachment members B16. The restraining member B15 is placed between the top lid portion B101*a* of the upper casing B101 and the attachment members B16 attached to the base B3. In this manner, the restraining member B15 can be easily fixed to the base B3 without using attachment screws or the like. Thus, the multi-directional input apparatus can be easily assembled.

In the above-described embodiment, the flange B12 which holds the coil spring B14 is attached to the operating shaft portion B1*a*. However, the coil spring B14 may also be held by a flange which is formed integrally with the operating shaft portion B1*a*. In addition, in the above-described embodiment, the receiving surface B15*a* is in surface-contact with the rubbing surface B13*b*. However, the rubbing surface B13*b* may also be in line contact or point contact with a receiving portion having a suitable shape that is provided on the inner wall of the restraining member B15. In addition, the present invention may also be applied to prevent rattling in multi-directional input apparatuses other than the force-sense-imparting input apparatus.

What is claimed is:

1. A multi-directional input apparatus comprising:

an operating member including a shaft portion, the shaft portion extending to the outside;

supporting means configured to support the operating member such that the shaft portion is tiltable in multiple directions;

detecting means configured to detect tilting of the shaft portion;

a restraining member provided with an opening and an annular edge portion surrounding the opening, the shaft portion extending through the opening, the annular edge portion serving as a receiving portion;

a sliding member fitted to the shaft portion such that the sliding member is movable in an axial direction; and an elastic member configured to elastically bias the sliding member against the receiving portion, wherein at least one of a rubbing portion of the sliding member and a receiving surface of the receiving portion has a spherical shape centered on a tilting center of the shaft portion, the rubbing portion being provided at one side of the sliding member, the receiving surface being in contact with the rubbing portion, and the elastic member is held by the operating member, wherein the sliding member has a rubbing surface at the first side thereof, the rubbing surface being in elastic contact with the receiving portion and being formed along a convex spherical surface centered on the tilting center of the shaft portion, wherein the elastic member includes a compression coil spring wound into a tapered shape, a diameter of the compression coil spring at a distal end being smaller than a diameter of the compression coil spring at a proximal end, and wherein the compression coil spring being disposed in a storage space provided at the other side of the sliding member, and the proximal end of the compression coil spring is held by a flange provided on the operating member, and the distal end of the compression coil spring elastically biases the sliding member in a direction away from the tilting center while a movement of the sliding member is restrained by the receiving portion.

2. The multi-directional input apparatus according to claim 1, wherein the elastic member includes a coil spring, the coil spring being disposed between a flange provided on the shaft portion and a spring receiver provided at the other side of the sliding member.

3. The multi-directional input apparatus according to claim 1, wherein the supporting means includes a drive member and a base, the drive member supporting the operating member with a first rotating shaft, the base supporting the drive member with a second rotating shaft, an axial direction of the second rotating shaft being perpendicular to an axial direction of the first rotating shaft, and the restraining member is provided on the base.

4. The multi-directional input apparatus according to claim 3, further comprising:

a housing configured to house the base, wherein the housing includes a top lid portion with an upper opening, the upper opening facing the opening in the restraining member and allowing the shaft portion to extend therethrough, and the restraining member is held between the top lid portion and the base.

5. The multi-directional input apparatus according to claim 4, wherein the restraining member is provided with a pair of positioning projections, the positioning projections being inserted in a pair of positioning holes provided in the base.

6. The multi-directional input apparatus according to claim 1, wherein the flange is externally fitted to the operating shaft portion and the flange and the sliding member are held in fitting engagement.

* * * * *